United States Patent [19]

Kane

[11] 3,998,183

[45] Dec. 21, 1976

[54] COATING MATERIAL APPLICATOR

[75] Inventor: John L. Kane, Newark, Ohio

[73] Assignee: Owens-Corning Fiberglas Corporation, Toledo, Ohio

[22] Filed: Mar. 12, 1975

[21] Appl. No.: 557,735

[52] U.S. Cl. ..... 118/420

[51] Int. Cl.[2] ..... B05C 3/15

[58] Field of Search ..... 118/419, 429, 420, 234, 118/DIG. 19, DIG. 22; 427/170, 175, 434; 65/3 R, 3 A, 3 B, 3 C; 222/189, 564; 68/200

[56] References Cited

UNITED STATES PATENTS

| | | | |
|---|---|---|---|
| 2,066,780 | 1/1937 | Holt | 118/126 X |
| 2,373,078 | 4/1945 | Kleist | 118/420 X |
| 2,772,518 | 12/1956 | Whitehurst et al. | 118/DIG. 19 |
| 2,934,458 | 4/1960 | Budd et al. | 65/3 B |
| 3,384,272 | 5/1968 | Federer | 222/189 |
| 3,507,250 | 4/1970 | Dew, Jr. | 118/420 X |
| 3,716,023 | 2/1973 | Walukonis, Jr. et al. | 118/420 |
| 3,718,117 | 2/1973 | Lewicki, Jr. | 118/414 |
| 3,758,329 | 9/1973 | Garick | 118/420 X |
| 3,780,699 | 12/1973 | Kime | 118/420 |
| 3,827,397 | 8/1974 | Hebberling | 118/50 |

*Primary Examiner*—Morris Kaplan
*Attorney, Agent, or Firm*—John W. Overman; Ronald C. Hudgens; Allen D. Gutchess, Jr.

[57] ABSTRACT

A coating material applicator is provided which applies a coating material to fibers, more specifically filaments, in a uniform manner. The applicator, which has no moving parts, directs the coating material in a tortuous path from a supply inlet to a filament-coating bar which applies the coating material to the filaments passing thereby. The tortuous path preferably has at least one inverted U-shaped portion which helps separate air trapped in the coating material. The applicator preferably has at least three chambers with the coating material passing down through the first chamber, up through the second, and down through the third from which it exits to the coating bar. Fibrous material can be located in the first chamber, and also in the second, if desired, to help separate and collect the air from the coating material. A vent also can be located in the first chamber and in the second, too, particularly if that chamber also has fibrous material therein, to vent the air periodically.

25 Claims, 8 Drawing Figures

COATING MATERIAL APPLICATOR

This invention relates to a coating applicator and specifically to one for applying size to glass fibers or filaments.

Numerous types of filament-coating applicators are known in the art for applying a coating material, especially a size, to glass filaments below a bushing from which they are attenuated and subsequently processed after the size is applied. While satisfactory size applicators have heretofore been employed, many have had moving parts which, of necessity, were subjected to wear and maintenance and which resulted in a relatively high cost for the applicators. Many applicators heretofore known also have been suitable for use with only a limited range of coating materials. Still others have not achieved uniform coating of the filaments, and in some instances, the filaments agglomerate at the applicator into bundles or groups, which is unsatisfactory when it is desired that the filaments initially retain their separate spacing from one another. Another problem with many applicators has been their inability to rid the coating material or size of air trapped therein, with the result that the air is carried to the point of application of the size to the filaments. One small air bubble can result in several hundred lineal feet of a filament not being coated.

The coating applicator according to the invention has a number of advantages over those heretofore known. The applicator has no moving parts, which help to make it low in cost and in operating expenses and maintenance requirements. The applicator is effective in separating air from the coating material to improve the uniformity of coating on the filaments. The applicator further includes an inexpensive filament-coating bar which physically maintains the filaments in separate, spaced relationship to further improve the uniformity of the coating. The new coating material applicator also can be effectively used with coating materials or sizes having a relatively wide range of viscosities.

The applicator in accordance with the invention has a housing forming an inlet chamber, an intermediate chamber, and an outlet chamber which are separated by baffles. The baffles are arranged so that the coating material moves down through the inlet chamber and up through the intermediate chamber and, finally, down through the outlet chamber to an outlet communicating with a filament-coating bar positioned in front of the housing to engage and coat the filaments. The coating bar has a multiplicity of transversely-extending grooves which receive individual filaments and maintain them in separate relationship while being coated to assure more uniform coating. The transverse grooves preferably are formed by a spiral thread on the bar extending substantially from one end to the other. The thread can be formed by conventional machining so as to enable the filament-coating bar to be low in cost.

The tortuous path of the coating material through the chamber enables air trapped therein to be collected in the first chamber which can contain fibrous material and can be provided with a suitable vent which can be periodically opened to vent the air. Fibers and a vent can also be located in the second chamber to trap additional air. The passages formed in the housing connecting the chambers can be adjusted in thickness by the use of shims to enable the applicator to accommodate many different coating materials having a wide range of viscosities. The passages are of a size such that the coating material is under some back pressure as it flows through the applicator, being supplied thereto by a suitable metering pump. The back pressure facilitates the removal of the air from the coating material and also helps to assure that the coating material will be supplied uniformly over the length of the filament-coating bar.

In some instances, the fibrous filtering material can be located in a supply line upstream of the applicator to remove at least most of the air before the coating material reaches the applicator. The fibrous material then can be eliminated from the applicator and it may be possible to employ only one chamber in the applicator, especially if the coating material is under some back pressure sufficient to assure a uniform supply to the filament-coating bar.

It is, therefore, a principal object of the invention to provide an improved coating material applicator having no moving parts.

Another object of the invention is to provide a coating material applicator which is low in cost and in maintenance requirements.

A further object of the invention is to provide a coating material applicator which is suitable for applying coating materials having a wide range of viscosities.

Yet another object of the invention is to provide a coating material applicator which is more effective in supplying coating material uniformly to filaments.

Yet a further object of the invention is to provide a coating material applicator which effectively separates air in the coating material therefrom prior to the material being applied to filaments.

Still another object of the invention is to provide a coating applicator which physically maintains the filaments separate from one another while they are being coated.

Still a further object of the invention is to provide a coating material applicator having a filament-coating bar with transverse grooves formed by a thread on the bar.

Many other objects and advantages of the invention will be apparent from the following detailed description of preferred embodiments thereof, reference being made to the accompanying drawings, in which.

Figure 1:
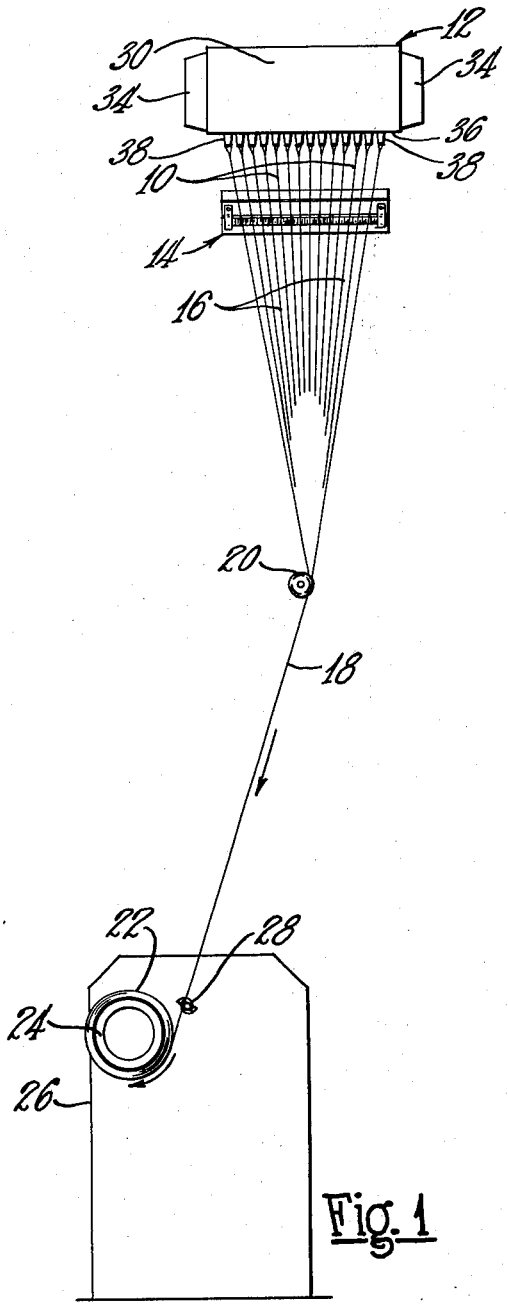
FIG. 1 is a front view in elevation of apparatus for forming and collecting filaments, and for coating them in accordance with the invention.
Figure 2:
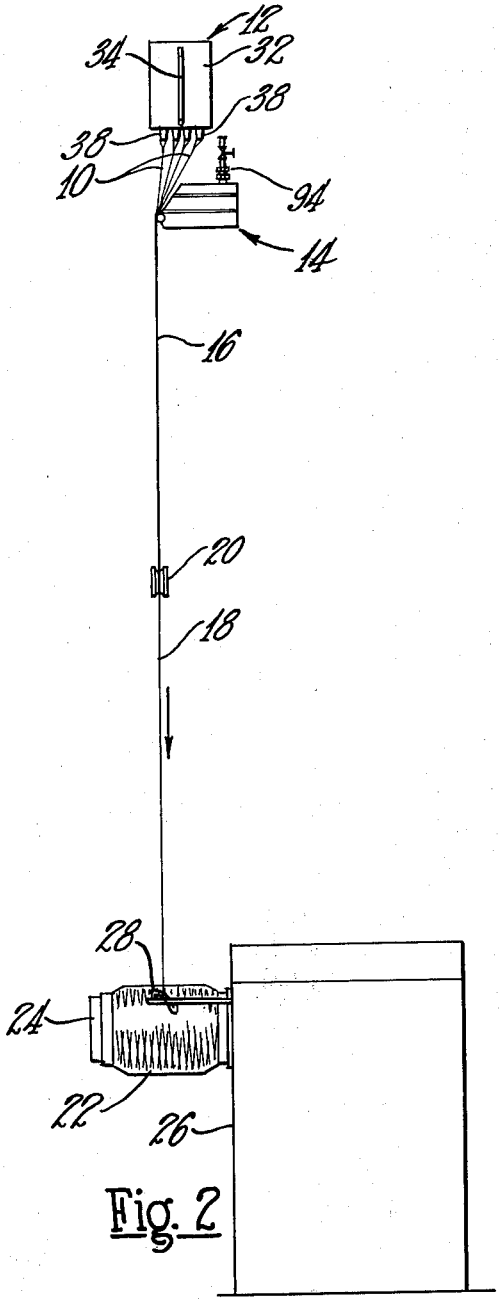
FIG. 2 is a side view in elevation of the apparatus of FIG. 1.

Referring to FIGS. 1 and 2, glass fibers or filaments 10 are attenuated from a bushing 12 and are then coated with suitable coating material or size at an applicator 14. Coated filaments 16 are then collected or gathered into a strand 18 by a gathering wheel or shoe 20. The strand 18 is then wound into a package 22 on a collet 24 of a winder 26 having a level winding device 28 thereon, as is well known in the art.

The bushing 12 can be of any suitable design and, as shown, includes platinum-alloy side walls 30 and end walls 32 which are heated electrically through ears 34. The bushing includes an elongate bottom wall 36 of a platinum-alloy having a multiplicity of bushing tips 38 forming orifices through which molten glass flows and from which the filaments 10 are attenuated. As shown, the orifices form a rectangular pattern with the tips 38 located in several parallel rows extending longitudinally of the bushing bottom 36.

Figure 3:
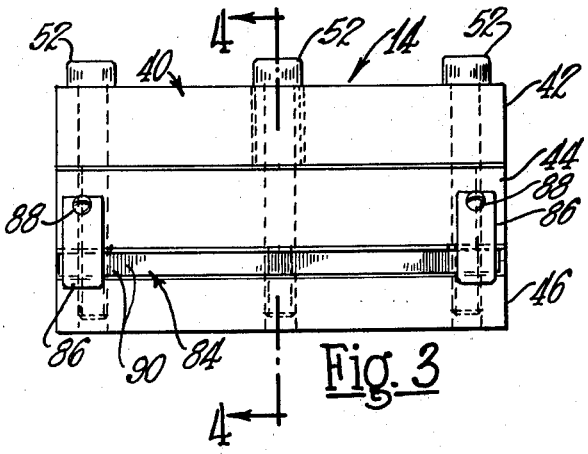
FIG. 3 is an enlarged, front view in elevation of a coating applicator in accordance with the invention.
Figure 4:
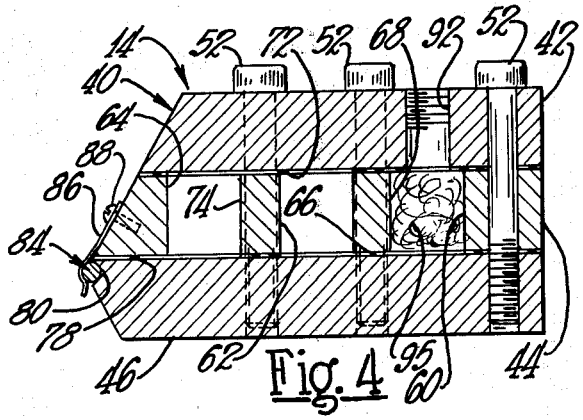
FIG. 4 is a view in transverse cross section taken along the line 4—4 of FIG. 3.
Figure 5:
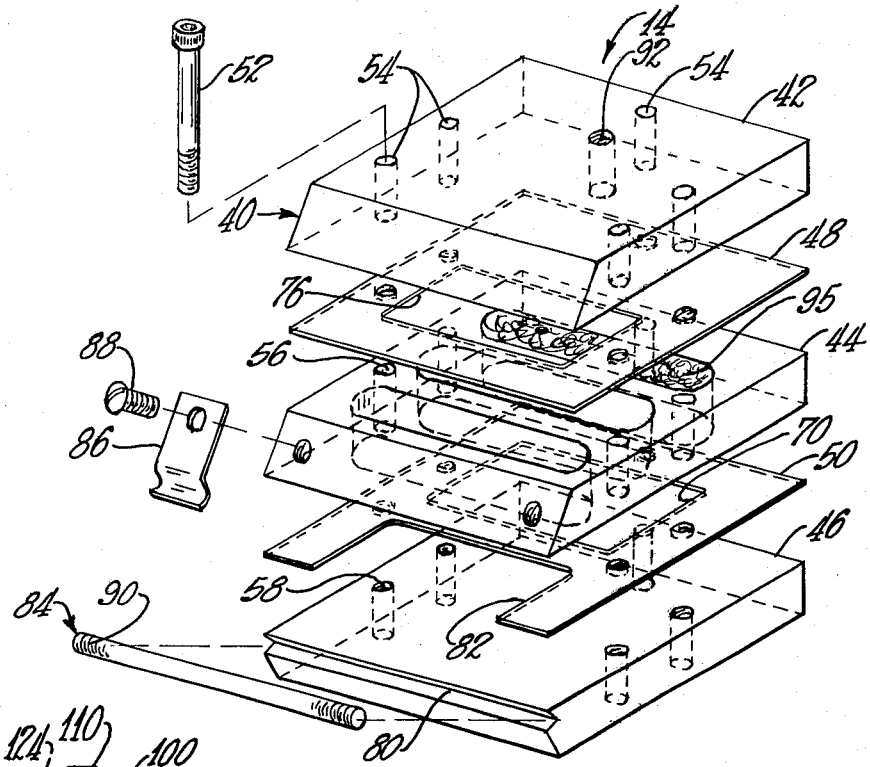
FIG. 5 is an exploded view in perspective of the applicator of FIGS. 3 and 4.

Referring more particularly to FIGS. 3–5, the coating material or size applicator 14 includes a main housing 40 having an upper housing section 42, an intermediate housing section 44, and a lower housing section 46. The applicator further includes an upper shim or separator plate 48 and a lower shim or separator plate 50 which are located between the upper housing section 42 and the intermediate housing section 44, and between the intermediate housing section 44 and the lower housing section 46, respectively. The housing sections and the shims are held in assembled relationship by machine screws 52 which extend through cylindrical openings 54 and 56 in the housing sections 42 and 44 and into threaded or tapped openings 58 in the lower section 46.

The housing 40 has three chambers therein including an inlet chamber 60, an intermediate chamber 62, and an outlet chamber 64. These are formed by three openings in the intermediate housing section 44 which cooperate with planar inwardly-facing surfaces on the upper section 42 and the lower section 46. The inlet chamber 60 communicates with the intermediate chamber 62 through a lower horizontal passage 66. The passage 66 is formed by a baffle or wall 68 in the intermediate housing section 44 which is spaced from the inner surface of the lower section 46 by the shim 50 and specifically by an opening 70 in the shim 50. The intermediate chamber 62 communicates with the outlet chamber 64 by an upper horizontally-extending passage 72. This is formed by a baffle or wall 74 in the intermediate housing section 44 which is spaced from the inner surface of the upper housing section 42 by the shim 48 and specifically by an opening 76 therein. The outlet chamber 64 also has an outlet passage 78 connecting the outlet chamber 64 with the forward face of the housing 40 just above a horizontally-extending groove 80 therein. The passage 78 is formed between adjacent planar surfaces of the housing sections 44 and 46 and by a notch or opening 82 in the shim 50.

An elongate filament-coating member in the form of a bar or rod 84 is positioned in the groove 80 and, in this instance, is releasably held by metal spring clips 86 fastened to the intermediate housing sections 44 by screws 88. The coating bar 84 preferably is of graphite or similar carbon-containing material. The bar 84 has a multiplicity of transversely-extending grooves or notches 90 which receive the individual filaments 10 when applying coating material thereto. The bar 84 thereby maintains the filaments 10 physically separated during coating, with the filaments being separated until they are collected by the gathering wheel 20. With the grooves 90, the filaments cannot tend to pull together and collect into bundles or small strands thereof which they otherwise have a tendency to do in the absence of any physical separation by the applicator 14. Further, it is not necessary that there be one of the filaments 10 in each of the grooves 90 and, in fact, the applicator 14 frequently is designed so that the number of the grooves 90 greatly exceeds the number of the filaments 10 so as to help assure that there will be no more than one filament in any one groove. As shown schematically in FIG. 5, the grooves 90 are formed by a spiral thread on the rod 84 which can be made by any conventional machining process. The thread enables the grooves to be formed inexpensively to contribute to the overall low cost of the applicator 14.

In operation, liquid coating material can be supplied by a suitable metering pump to an inlet opening 92 in the upper housing section 42, the opening communicating with the inlet chamber 60. The coating material flows down through the chamber 60, through the lower passage 66, and up through the intermediate chamber 62 to the upper passage 72. Finally, the coating material flows down through the outlet chamber 64 and through the lower passage 78 to the coating bar 84 where the coating material flows over the bar and down into the grooves 90. The passages 66, 72, and 78 are designed to provide some back pressure for the coating material in the three chambers 60, 62, and 64, which assures that the coating material will be supplied uniformly through the passage 78 and over the entire bar 84, with the coating material then being supplied to each of the grooves 90 so that each of the filaments 10 will be fully coated.

The tortuous path of the coating material entering the opening 92 causes any air trapped therein to be separated therefrom and collected particularly in the upper portion of the chamber 60. With the parth having at least one downwardly-extending portion and preferably an inverted U-shaped portion as the material flows up through the outlet chamber 64, it is virtually assured that any air trapped will be separated before the coating material reaches the coating bar 84.

As shown in FIG. 2, the chamber 60 can have a suitable valve-controlled vent 94 which can be periodically opened to expel or vent air collected in the chamber 60. Further, fibrous material 95, such as a mass of heterogeneously-disposed glass fibers, can be employed in the chamber 60, if desired, to further aid in separating the air from the coating material. The fibrous material can also be located in the chamber 62 to trap additional air, if necessary, in which case the chamber 62 can also have a vent. It is also possible to place the fibrous material in a supply line upstream of the applicator 14 rather than in the applicator. The chambers in the applicator can then be reduced in size although a tortuous path is still desirable for the coating material to maintain back pressure.

As a practical matter, coating materials having a wide range of viscosities can be employed with the applicator 14. For example, a size having a viscosity from 50 to 3,000 cps can be employed satisfactorily in the coating material applicator 14 by the use of different shims of suitable thicknesses. By way of example, coating material having low viscosity can have shims as thin as one mil or thinner while coating material with high viscosity can have shims as thick as 10 mils. The shims can be readily selected to provide a back pressure of the coating material in the chambers 60, 62, and 64 to assure uniform flow through the passages in the applicator to the filament-coating bar 84.

Figure 8:
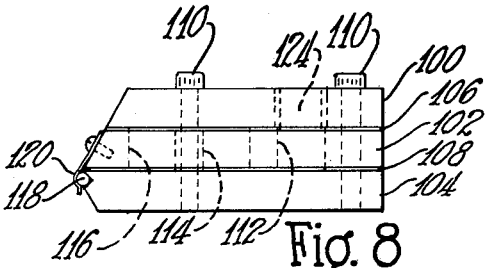
FIG. 8 is a side view of the applicator of FIGS. 6 and 7.
Figure 6:
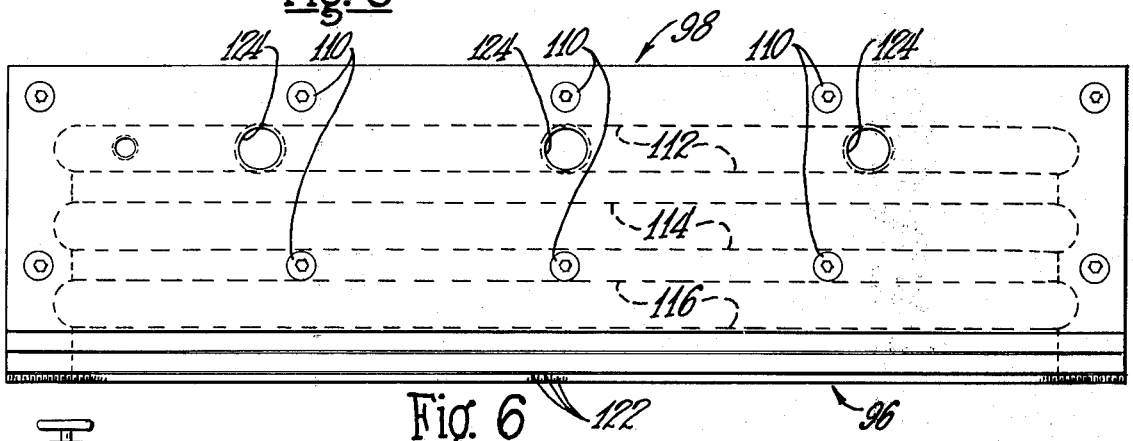
FIG. 6 is a top view of a slightly modified applicator.
Figure 7:
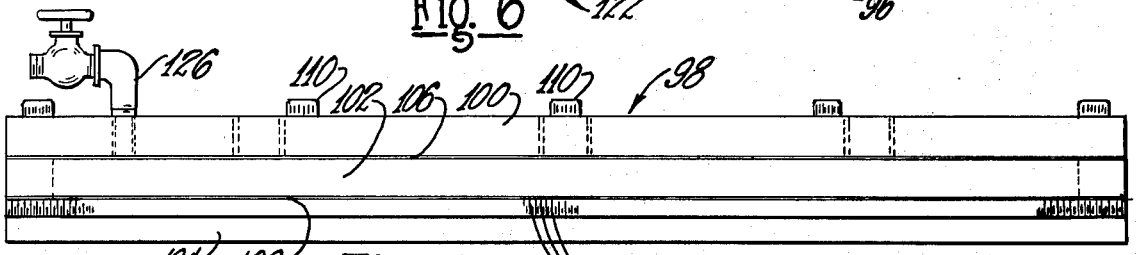
FIG. 7 is a front view of the applicator of FIG. 6.

A slightly modified coating material applicator 96 is shown in FIGS. 6–8. The applicator includes a main housing 98 having an upper housing section 100 and an intermediate housing section 102, and a lower housing section 104. The housing 98 is much longer than the housing 40 and is capable of coating a much wider fan of filaments being attenuated from a bushing. The applicator further includes an upper shim or separator plate 106 and a lower shim or separator plate 108 which are located between the upper housing section 100 and the intermediate housing section 102, and between the intermediate housing section 102 and the lower housing section 104, respectively. The housing sections and shims are held in assembled relationship by machine screws 110 which extend through cylindrical openings in the housing sections 100 and 102 and into threaded or tapped openings in the lower section 104, similar to the arrangement for the applicator 14.

The housing 98 has three chambers therein, including an inlet chamber 112, an intermediate chamber 114, and an outlet chamber 116, similar to those of the applicator 14. These are formed by the three housing sections 100, 102, and 104 in the same manner as the applicator 14 and will not be discussed in detail. The three chambers are connected by passages similar to those of the applicator 14, with the supply chamber 112 communicating with the intermediate chamber 114 through a lower horizontal passage and with the intermediate chamber 114 communicating with the outlet chamber 116 through an upper horizontal passage, these passages being formed by the housing sections and the shims, as before. The outlet chamber 116 also has a lower, horizontal outlet passage connecting the chamber 116 with the forward face of the housing 98 just above a horizontally-extending groove 118 therein.

A filament-coating bar or rod 120 is positioned in the groove 118 and, in this instance, is releasably held by a putty-like compound at the back of the rod which does not fully harden so that the rod can be readily replaced, when desired. The rod 120 again is preferably of graphite or similar carbon-containing material and has transversely-extending grooves or notches 122 which receive the individual filaments 10 when applying coating material thereto. The rod thereby maintains the filament separate and prevents them from pulling together at the applicator. The grooves again can be formed by a spiral thread on the rod to provide an inexpensive applicator.

In this instance, the applicator 96 has three inlet openings 124 communicating with the inlet chamber 112. The coating material thus can be supplied through any one of the openings 124 to accommodate the particular installation. Further, especially when lower viscosity coating materials are employed, all three of the inlet openings 124 can be used to supply the material more uniformly to the inlet chamber 112 so that it correspondingly moves more uniformly through the other chambers and to the rod 120. The flow of the coating material through the applicator 96 is similar to that of the applicator 14 with air in the coating material being separated therefrom and collected in the chamber 112. A mass of heterogeneously-disposed glass fibers can also be employed in this chamber and in the chamber 114, if desired. Again, a vent 126 can be used in either or both chambers to vent the air therefrom periodically.

Various modifications of the above-described embodiments of the invention will be apparent to those skilled in the art, and it is to be understood that such modifications can be made without departing from the scope of the invention, if they are within the spirit and the tenor of the accompanying claims.

I claim:

1. An applicator for applying a coating material to a plurality of filaments moving in lineal paths in side-by-side relationship, said applicator comprising means forming an inlet chamber, an intermediate chamber, and an outlet chamber, means forming a first passage between a lower portion of said inlet chamber and a lower portion of said intermediate chamber, means forming a second passage between an upper portion of said intermediate chamber and an upper portion of said outlet chamber, said applicator having elongate filament-coating means, and means forming a third passage connecting a lower portion of said outlet chamber with said filament-coating means to supply coating material to said filament-coating means for coating filaments moving thereacross.

2. An applicator according to claim 1 characterized by fibrous means in at least one of said inlet and intermediate chambers to aid in collecting air from the coating material.

3. Applicator according to claim 2 characterized by a vent in at least one of said inlet and intermediate chambers.

4. An applicator according to claim 1 characterized by said filament-coating means having a plurality of transversely-extending grooves in which the filaments and the coating material are received.

5. An applicator according to claim 4 characterized by said filament-coating means being a rod and said grooves being formed by a spiral thread on said rod.

6. An applicator according to claim 1 wherein said filament-coating means is made of a carbon-containing material.

7. An applicator according to claim 1 characterized by said filament-coating means is made of graphite.

8. An applicator according to claim 1 characterized by said third passage supplying coating material to the top of said filament-coating means.

9. An applicator for applying a coating material to a plurality of filaments attenuated from a bushing above the applicator and moving in a downward direction, said applicator comprising means forming a plurality of chambers, including an inlet chamber, an intermediate chamber, and an outlet chamber, inlet means communicating with said inlet chamber for supplying coating material thereto, elongate filament-coating means communicating with said outlet chamber, and passage means connecting said three chambers in a manner such that the coating material moves in a tortuous path having at least one downwardly directed portion as it moves from said inlet means to said filament-coating means.

10. An applicator according to claim 9 characterized by said coating material path having at least one inverted U-shaped portion.

11. An applicator according to claim 9 characterized by fibrous means in said inlet chamber to aid in separating air from the coating material.

12. An applicator according to claim 9 characterized by there being a vent in said inlet chamber.

13. An applicator according to claim 9 characterized by said filament-coating means having a plurality of transversely-extending grooves in which the filaments and the coating material are received.

14. An applicator according to claim 13 characterized by said filament-coating means being a rod and said grooves being formed by a spiral thread on said rod.

15. An applicator according to claim 14 characterized by means for releasably attaching said rod to said applicator.

16. An applicator according to claim 13 characterized by said filament-coating means being made of a carbon-containing material.

17. An applicator according to claim 13 characterized by said filament-coating means being made of graphite.

18. An applicator according to claim 9 wherein the said filament-coating means communicating with said outlet chamber comprises a passage which supplies the coating material to the top of said filament-coating means.

19. An applicator according to claim 9 characterized by said applicator having a groove communicating with said outlet chamber, and said elongate filament-coating means being located in said groove, but having a peripheral portion extending outwardly beyond said applicator.

20. An applicator according to claim 9 wherein said applicator forming means further comprises a plurality of separable body sections forming the plurality of chambers, said body sections including an upper body section, an intermediate body section, and a lower body section.

21. An applicator according to claim 20 characterized by a vent communicating with at least one of said plurality of chambers.

22. An applicator according to claim 20 characterized by fibrous material located in at least one of said plurality of chambers.

23. An applicator according to claim 9 wherein said filament-coating means comprises a filament-coating rod carried by said applicator, said rod being made of carbon-containing material and of circular cross section, said rod having transverse grooves formed therein to receive individual filaments, said grooves being formed by a spiral thread extending a substantial portion of the length of said rod.

24. An applicator according to claim 23 characterized by said applicator having a groove communicating with said outlet chamber, said rod being located in said groove and having a peripheral portion extending outwardly beyond said applicator to receive the filaments.

25. An applicator according to claim 23 wherein said rod is made of graphite.

* * * * *